US010253525B2

(12) United States Patent
Hunt

(10) Patent No.: US 10,253,525 B2
(45) Date of Patent: Apr. 9, 2019

(54) LOCK PLATE FOR SPRING LOCK

(71) Applicant: Timothy W. Hunt, St. Louis, MO (US)

(72) Inventor: Timothy W. Hunt, St. Louis, MO (US)

( * ) Notice: Subject to any disclaimer, the term of this patent is extended or adjusted under 35 U.S.C. 154(b) by 253 days.

(21) Appl. No.: 14/724,981

(22) Filed: May 29, 2015

(65) Prior Publication Data

US 2016/0348396 A1 Dec. 1, 2016

(51) Int. Cl.
*E05B 17/20* (2006.01)
*E05B 15/02* (2006.01)

(52) U.S. Cl.
CPC ..... *E05B 17/2003* (2013.01); *E05B 15/0205* (2013.01)

(58) Field of Classification Search
CPC ..... Y10T 292/68; Y10T 292/694; Y10T 70/7927; Y10T 292/683; Y10T 292/691; E05B 15/0205; E05B 17/2084
See application file for complete search history.

(56) References Cited

U.S. PATENT DOCUMENTS 130,311 A 8/1872 Aktho et al.
525,074 A 8/1894 Gray
1,091,453 A 3/1914 Fletcher
2,816,788 A 12/1957 Henry
3,154,343 A 10/1964 Devine
3,257,139 A * 6/1966 Russell ..... E05B 15/0245 292/341.18
3,405,962 A 10/1968 Sushan
3,416,829 A * 12/1968 Russell ..... E05B 15/0245 292/341.18
3,449,006 A 6/1969 Petri
3,506,293 A * 4/1970 Armstrong ..... E05B 15/0245 292/341.19
3,524,669 A * 8/1970 Reid ..... E05B 17/2003 292/346
3,764,173 A 10/1973 Griffith
3,874,717 A 4/1975 Pratt
3,967,845 A 7/1976 Governale
4,105,235 A * 8/1978 Thiel ..... E05B 15/0245 292/341.18
4,130,311 A * 12/1978 Sushan ..... E05B 17/2003 292/346
4,178,027 A 12/1979 Charron
(Continued)

FOREIGN PATENT DOCUMENTS

CA 979051 12/1975

OTHER PUBLICATIONS

International Search Report and Written Opinion of the International Searching Authority in co-pending PCT/US2016/033939.

*Primary Examiner* — Mark A Williams
(74) *Attorney, Agent, or Firm* — Grace J. Fishel

(57) ABSTRACT

A lock plate for use as a guard for a latch bolt of a spring lock. The lock plate has a flat face portion with a curved first end and an L-shaped second end including a curved outwardly and forwardly extending arm. A recess is formed in the flat face portion from which a tongue extends. The lock plate is configured to nest on a striker plate of a spring lock for attachment with same screws by which the striker plate is attached to a door jamb. The outwardly and forwardly extending arm and the tongue blocking access to the latch bolt by a foreign object such as a credit card.

8 Claims, 4 Drawing Sheets

(56) References Cited

U.S. PATENT DOCUMENTS

| | | | | |
|---|---|---|---|---|
| 4,345,787 | A | 8/1982 | Dabrowski | |
| 4,383,709 | A * | 5/1983 | Ronan | E05B 17/2003 292/340 |
| 4,629,231 | A | 12/1986 | Bouchard | |
| 4,953,901 | A | 9/1990 | Hegdahl | |
| 5,074,606 | A | 12/1991 | Priola et al. | |
| 5,094,489 | A * | 3/1992 | Jones | E05B 15/0205 292/340 |
| D351,781 | S * | 10/1994 | DeWitt | D8/343 |
| 6,406,076 | B1 | 6/2002 | Zarzycki, Jr. | |
| D474,675 | S | 5/2003 | Simon | |
| 6,612,629 | B2 | 9/2003 | O'Hanlon | |
| D514,919 | S | 2/2006 | Czerwinski | |
| 7,240,931 | B1 * | 7/2007 | Casey | E05B 15/024 292/288 |
| 8,857,864 | B2 | 10/2014 | Snyder, Jr. et al. | |

* cited by examiner

LOCK PLATE FOR SPRING LOCK

FIELD OF THE INVENTION

The present invention relates to a lock plate configured to functionally cooperate with a striker plate as a guard for a latch bolt of a spring lock.

BRIEF DESCRIPTION OF THE PRIOR ART

In a conventional residential entry door with a spring lock, a vertical stop strip is fixed to the jamb toward the exterior side of the door structure for abutment stopping of the door in the frame. A striker plate is provided on the jamb at a location to be struck by the latch bolt on swinging closure of the door in the frame. For ease of action, the latch bolt has an oblique surface to provide for smooth retraction of the latch bolt as it slides over the striker plate and into a hole provided in the striker plate and door jamb. On an inwardly swinging door, this oblique surface if pushed on from the outside by a foreign object such as a credit card, screwdriver or the like may be used to retract the latch bolt and gain access through an otherwise locked door.

In order to be tamper proof, a conventional spring lock relies on tight installation of a door frame against the edge of a door to leave no room for inserting a foreign object into the gap between the vertical stop strip and the door. Over time, however, doors which are initially installed without excessive gaps between the door and the door frame can suffer from deterioration in their installation due to loose or improperly mounted hinges, shrinkage or warping of the wood, or even setting of the house. Incorrect sizing of doors further adds to the gaps created between doors and their respective door frames. There are repairs that can be made to correct warps and looseness of a door in a door frame but in general no action is taken immediately. The work usually requires taking the door down and is beyond the skills of many home owners and tenants are not motivated. Hence there is a need for a lock plate for guarding the latch bolt in imperfect door lock installations. More particularly, there is a need for a lock plate that is simple to install (e.g., with a screwdriver) without making any modification to existing door lock installations.

BRIEF SUMMARY OF THE INVENTION

In view of the above, it is an object of the present invention to provide a guard for latch bolt of a spring lock. It is another object to provide a guard which is simple to install and which does not require modification of an existing door lock installation. It is also an object to provide a guard may be inexpensively made. Other objects and features of the invention will be in part apparent and in part pointed out hereinafter.

In accordance with the invention, a lock plate for a latch bolt of a spring lock is formed from a unitary member. The lock plate has a face portion with first and second ends and upper and lower edges defining a horizontal and vertical dimension respectively. The face portion includes a recess for receiving a latch bolt and spaced mounting holes with a tongue along a side of the recess towards the second end. The first end of face portion merges into an inwardly curved lip portion and the second end has an L-shaped end with an outwardly and forwardly curved arm. The lock plate is configured to nest on a striker plate of a spring lock with the tongue received in a recess provided in the striker plate for receiving a latch bolt and with the mounting holes in the face portion of the lock plate in registry with mounting holes in the striker plate. The same screws by which the striker plate is attached to a door jamb may be used to attach the nested combination.

in one embodiment, the L-shaped second end has a flat leg is configured to fit along an inside edge of a stop strip of the door jamb. In other embodiments, the recess for receiving a latch bolt and spaced mounting holes are towards the second end of the face portion. In some embodiments, the first and second ends of the lock plate are configured to extend beyond the striker plate.

Usually, the tongue extends from a side of the recess in the face portion proximate the second end and may be either generally perpendicular to the face portion or configured to bend around an underside of the striker plate.

The invention summarized above comprises the constructions hereinafter described, the scope of the invention being indicated by the subjoined claims.

BRIEF DESCRIPTION OF THE SEVERAL VIEWS OF THE DRAWING

In the accompanying drawings, in which several of various possible embodiments of the invention are illustrated, corresponding reference characters refer to corresponding parts throughout the several views of the drawings in which.

DETAILED DESCRIPTION OF THE INVENTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to make or use the embodiments of the disclosure and are not intended to limit the scope of the disclosure, which is defined by the claims. For purposes of description herein, the terms "upper," "lower," "left," "rear," "right," "front," "vertical," "horizontal," and derivatives thereof shall relate to the invention as oriented in FIG. 1. Furthermore, there is no intention to be bound by any expressed or implied theory presented in the preceding technical field, background, brief summary or the following detailed description. It is also to be understood that the specific devices and processes illustrated in the attached drawings, and described in the following specification, are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 1:
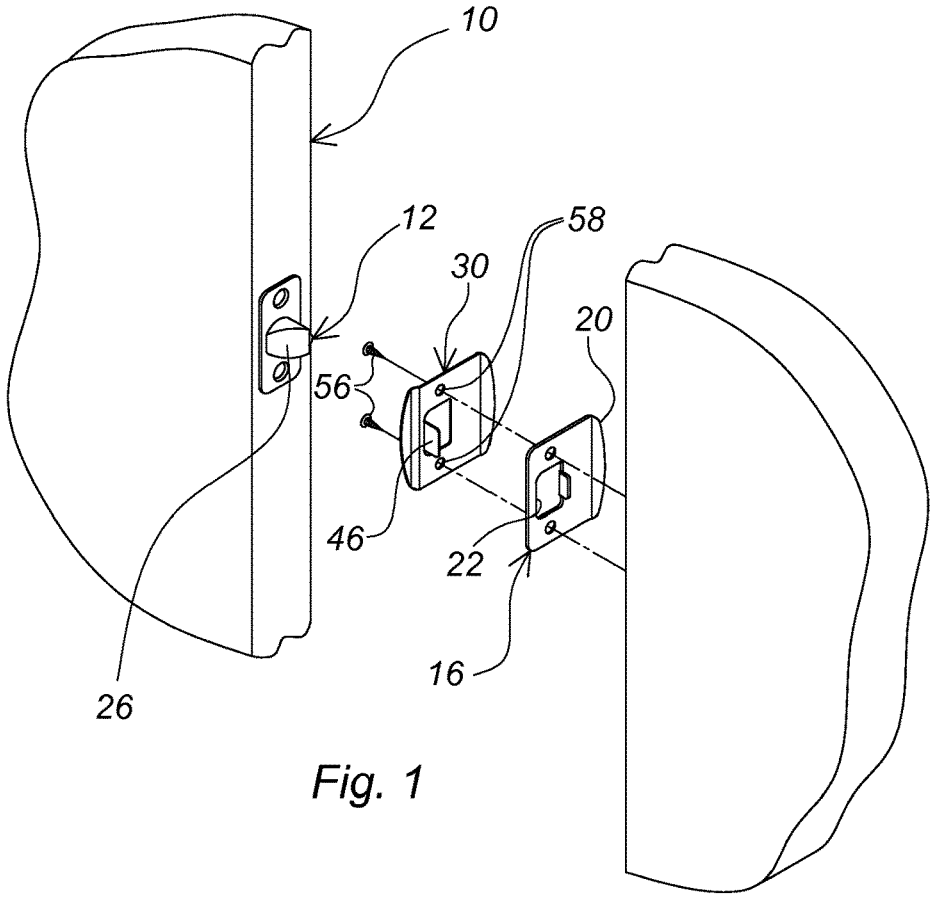
FIG. 1 is a perspective view of a door with an exploded view of a striker plate and lock plate in accordance with the invention.
Figure 2:
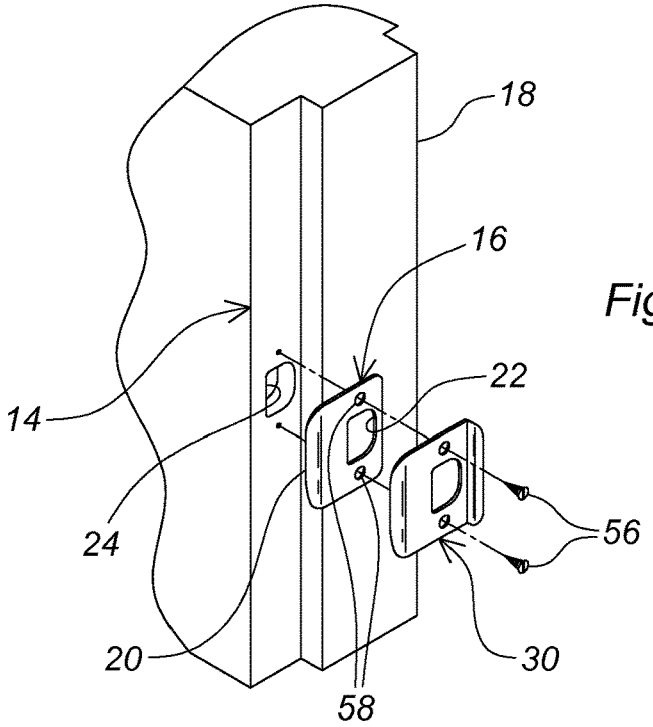
FIG. 2 is a perspective view of a door jamb with an exploded view of the striker plate and lock plate.
Figure 3:
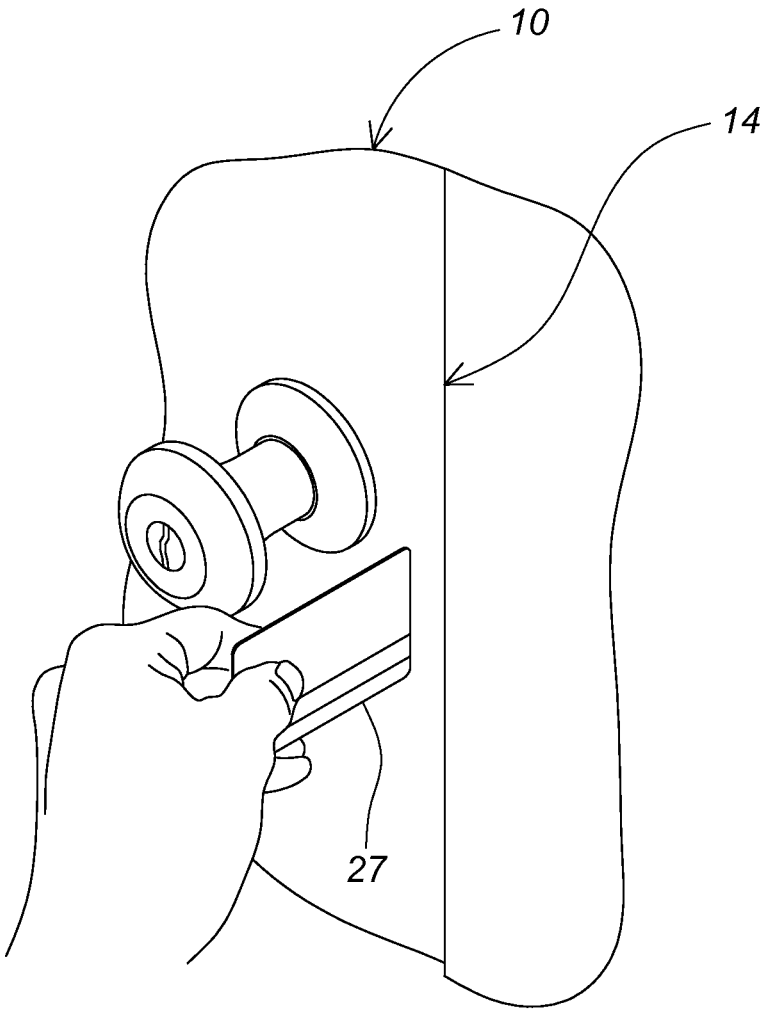
FIG. 3 illustrates the manner in which a charge card or other foreign object may gain access through a locked door.

Referring to the drawings more particularly by reference character, FIG. 1 is a partial perspective view of an inwardly swinging door 10 with a spring loaded latch bolt 12 and FIG. 2 is a partial perspective view of a door jamb 14 with a striker plate 16 for latch bolt 12. Door jamb 14 includes a vertical stop strip 18 which acts as a stop for closing door 10 and also serves as a blockage to prevent tampering attempts. Striker plate 16 has a curved lip 20 and provides a strike surface to guide latch bolt 12 which is springingly engaged with a lock mechanism (not shown) housed in door 10. When the door is closed, latch bolt 12 retracts as it engages striker plate 16 before reaching a hole 22 in striker plate 16 which aligns with a hole 24 in door jamb 14. An oblique surface 26 of latch bolt 12 minimizes the impact of the contact and provides for smooth retraction of latch bolt 12. As the installation deteriorates or if the installation was improperly done, a gap 28 between door jamb 14 and door 10 may become large enough (FIG. 4) that a credit card 27, shaft of a screwdriver, shim or other such foreign object may be easily inserted between stop strip 18 and a leading edge of door 10. Using such a tool, an intruder may retract latch bolt 12 by pushing on oblique surface 26 and gain entry through the locked door. Even with a properly fitting door 10, entry to oblique surface 26 may be had by chipping away stop strip 18 around striker plate 16 and the security of the lock compromised.

With continuing reference to FIGS. 1 and 2, a lock plate 30 is provided that is configured to functionally cooperate with striker plate 16 as a guard for latch bolt 12. As will become apparent, lock plate 30 is universally adaptable to existing conventional door lock installations and simple to install with a screwdriver without making modifications. In addition, lock plate 30 may be economically manufactured.

As best seen in FIGS. 5-8, lock plate 30 comprises a unitary member, preferably made of metal with a chrome or brass finish but which may be made of a resilient plastic material or the like. Lock plate 30 has a face portion 32 with first and second ends 34, 36 and upper and lower edges 38, 40 defining a horizontal and vertical dimension, respectively. Face portion 32 has a recess 42 for receiving latch bolt 12 and spaced mounting holes 44 toward second end 36. A tongue 46 extends from a side of recess 42 proximate second end 36. As shown in FIG. 1, tongue 46 may extend generally perpendicular to face portion 32 or may be doubled back along an underside 48 of face portion 32 as shown in FIGS. 5-8. First end 34 of face portion 32 merges into an inwardly curved lip portion and second end 36 merges into an L-shaped end with a generally flat leg 50 (FIG. 4A) and an outwardly and forwardly curved arm 52. Curved lip 34 is shaped to closely fit the curve in striker plate 16. Flat leg 50 of L-shaped end 36 is formed to fit along an inside edge 54 of stop strip 18 while curved arm 52 extends outwardly and forwardly to fill gap 28. In the absence of a sizable gap 28, arm 52 is pinched between door 10 and door jamb 14 and cams along the door edge. When not needed to fill gap 28, curved arm 52 still serves as a guard to latch bolt 12 in the event an intruder chips away a portion of stop strip 18 with an awl or some other tool.

In use, screws 56 for mounting striker plate 16 are removed. Lock plate 30 is configured to nest over striker plate 16 and be attached with the original screws 56 used to attach the striker plate to door jamb 14 with mounting holes 44 in lock plate 30 in registry with mounting holes 58 in striker plate 16. First and second ends 34, 36 of lock plate 30 extend beyond the ends of striker plate 16 and tongue 46 passes through hole 22 in the striker plate and is received in hole 24 in door jamb 14. The installation is easily done by a person with a screwdriver. No special skills are required and renters may add lock plate 30 without authorization as it does not require any modification of the existing door lock installation.

Figure 4A:
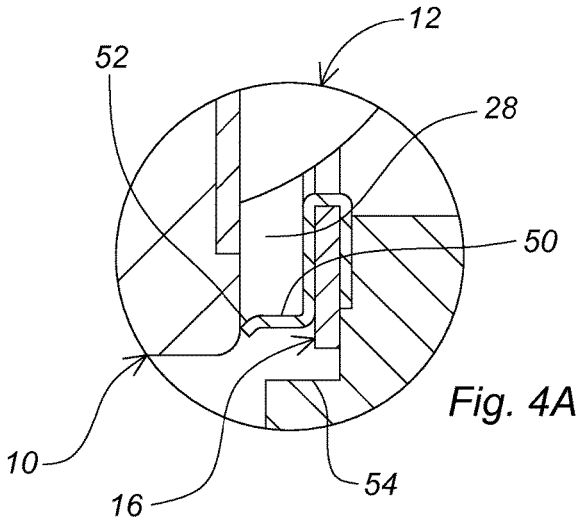
FIG. 4A is a detail on a further enlarged scale taken along the line of 4A-4A in FIG. 4.
Figure 4:
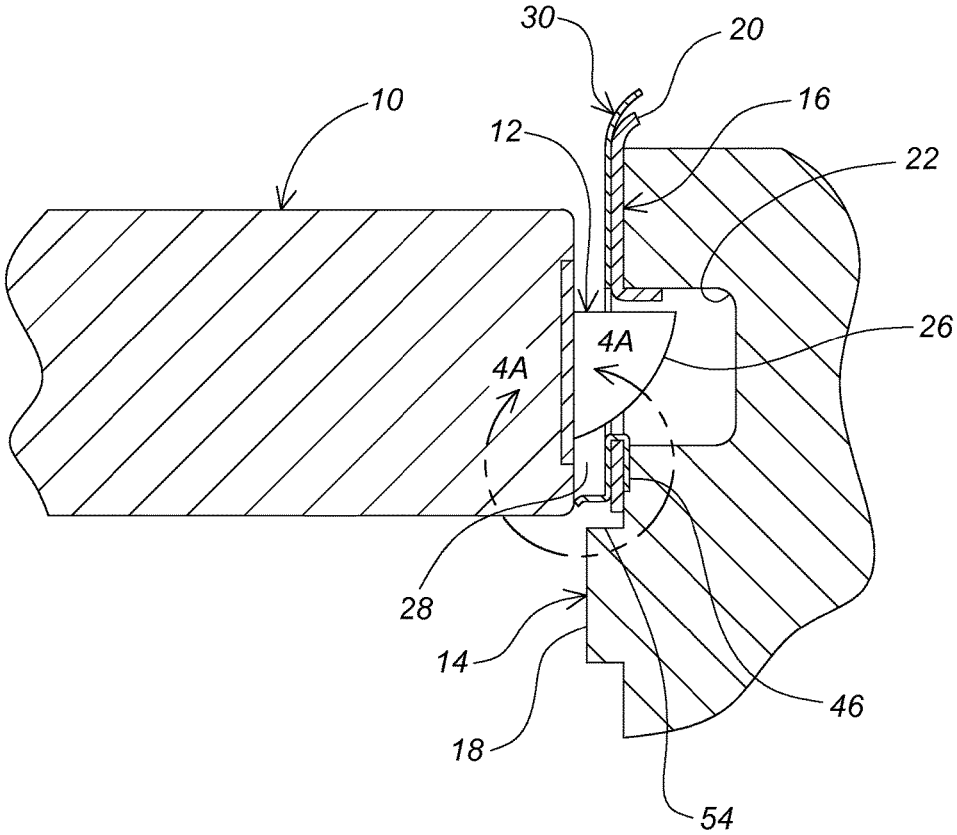
FIG. 4 is a cross-section on an enlarged scale showing the lock plate installed over the striker plate and illustrating the gap which may form between the door and the door jamb.
Figure 7:
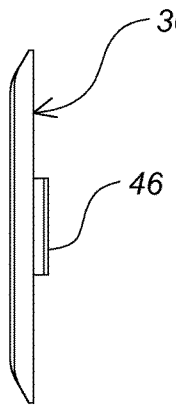
FIG. 7 is an end elevation of a second, L-shaped end of the lock plate; and, FIG. 8 is an end elevation of a first, curved lip end of the lock plate.
Figure 5:
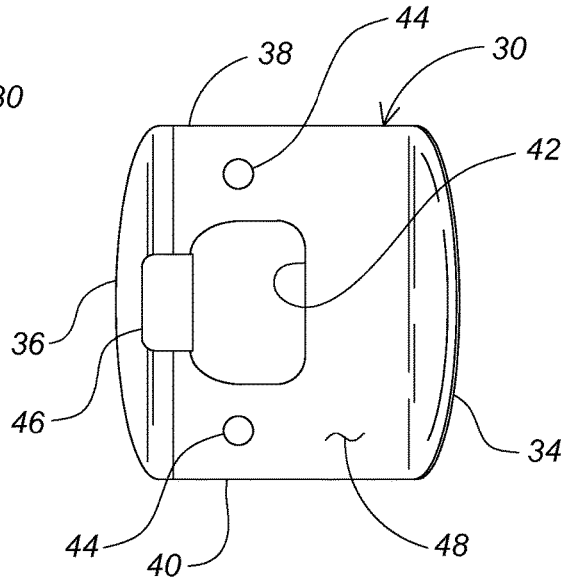
FIG. 5 is plan view of an underside of the lock plate.
Figure 8:
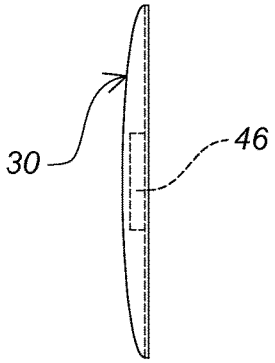
Figure 6:
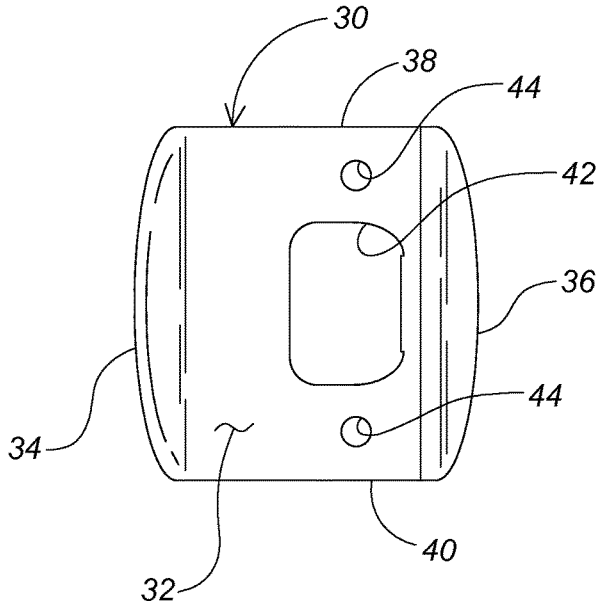
FIG. 6 is a plan view of a top side of the lock plate.

In place, lock plate 30 provides much of the security of a dead bolt without the disadvantages and expense of a dead bolt. As door 10 is closed against stop strip 18, curved arm 52 blocks entry of a foreign object into gap 28 to latch bolt 12. If the gap is smaller than illustrated in FIG. 4, a forward end of curved arm 52 cams along the edge of door 10 and is bent forward as the door closes, still serving the function of blocking access to latch bolt 12. Lock plate 30 also blocks access to latch bolt 12 from underside 48 of face portion 32 with tongue 46 whether as shown in FIG. 1 or in FIGS. 4 and 4A. When bent around face portion 32 as shown in FIGS. 4 and 4A, tongue 46 has additional resistance to being plied up and pushed out of the way.

In the above description, numerous specific details are set forth such as examples of some embodiments, specific components, devices, methods, in order to provide a thorough understanding of embodiments of the present disclosure. It will be apparent to a person of ordinary skill in the art that these specific details need not be employed, and should not be construed to limit the scope of the disclosure. In the development of any actual implementation, numerous implementation-specific decisions must be made to achieve the developer's specific goals, such as compliance with system-related and business-related constraints. Such a development effort might be complex and time consuming, but is nevertheless a routine undertaking of design, fabrication, and manufacture for those of ordinary skill. Hence as various changes could be made in the above constructions without departing from the scope of the invention, it is intended that all matter contained in the above description or shown in the accompanying drawings shall be interpreted as illustrative and not in a limiting sense.

What is claimed:

1. A lock plate for a latch bolt of a spring lock, said lock plate comprising a unitary member having a face portion and an underside portion, said face portion configured with first and second ends and upper and lower edges defining a horizontal and vertical dimension respectively, said face portion having a recess for receiving a latch bolt and spaced mounting holes, a tongue along a side of the recess proximate the second end, said first end merging into a lip portion curved away from the front face portion towards the underside portion and said second end having an L-shaped end with an arm curved away from the front face portion, said lock plate configured to interact with and nest on a striker plate of a spring lock with the tongue received in a recess provided in the striker plate for receiving a latch bolt, said mounting holes in the face portion of the lock plate configured to interact with and be in registry with mounting holes in the striker plate, whereby said lock plate is constructed to be attached to the striker plate with screws used for attaching the striker plate to a door jamb.

2. The lock plate of claim 1 wherein the L-shaped end has a flat leg configured to fit along an inside edge of a stop strip of the door jamb.

3. The lock plate of claim 2 wherein the recess for receiving a latch bolt and spaced mounting holes are proximate the second end of the face portion.

4. The lock plate of claim 2 wherein the first and second ends of the lock plate are configured to next on the striker plate.

5. The lock plate of claim 1 wherein the tongue extends from a side of the recess in the face portion proximate the second end.

6. The lock plate of claim 5 wherein the tongue is generally perpendicular to the face portion.

7. The lock plate of claim 5 wherein the tongue is configured to bend around an underside of the striker plate.

8. The lock plate of claim 1 formed of metal with a chrome or brass finish.

* * * * *